United States Patent [19]

Hook

[11] Patent Number: 4,860,367

[45] Date of Patent: Aug. 22, 1989

[54] LOW FREQUENCY LOUD SPEAKER

[76] Inventor: Carl R. Hook, Peachtree Apts., #100 Berry Hill Rd., Columbia, S.C. 29210

[21] Appl. No.: 181,966

[22] Filed: Apr. 15, 1988

[51] Int. Cl.[4] ..... G10K 11/02

[52] U.S. Cl. ..... 381/156; 181/152; 181/159; 181/194

[58] Field of Search ..... 181/152, 159, 194; 381/156

[56] References Cited

U.S. PATENT DOCUMENTS 1,878,018 9/1932 Stephens ..... 181/159
2,604,182 7/1952 Massa ..... 181/159

FOREIGN PATENT DOCUMENTS 342369 2/1931 United Kingdom ..... 181/152

*Primary Examiner*—Forester W. Isen
*Attorney, Agent, or Firm*—Michael A. Mann

[57] ABSTRACT

A low frequency loud speaker is disclosed for use in a room at the intersection of two, mutually perpendicular planes, such as a ceiling and a wall, a floor and a wall or two walls. The speaker has a back air chamber within which an electrically-driven diaphragm, centered on and facing a vent cut through the chamber's rear surface, projects low frequency sound waves into the throat of a compact, bifurcated, exponential horn folded around the sides of the chamber to the mouth of the horn at the back of the speaker. The back air chamber receives sound waves from the rear face of the diaphragm and causes these back waves to acoustically activate the air in the vent above and below the diaphragm. The sound waves are projected from the back of the speaker into a space defined by the rearwardly projecting top of the speaker, the intersecting planes and the back of the speaker so that the two planes, the projecting top, the back of the speaker and the outsides of the speaker further improve the impedence match between the mouth of the horn and the room, achieving a fidelity of the low frequencies from 40 Hz to 400 Hz previously found only in corner-placed speakers, where mid-range frequencies suffer, or in speakers of much greater size.

14 Claims, 2 Drawing Sheets

FIG. 4.
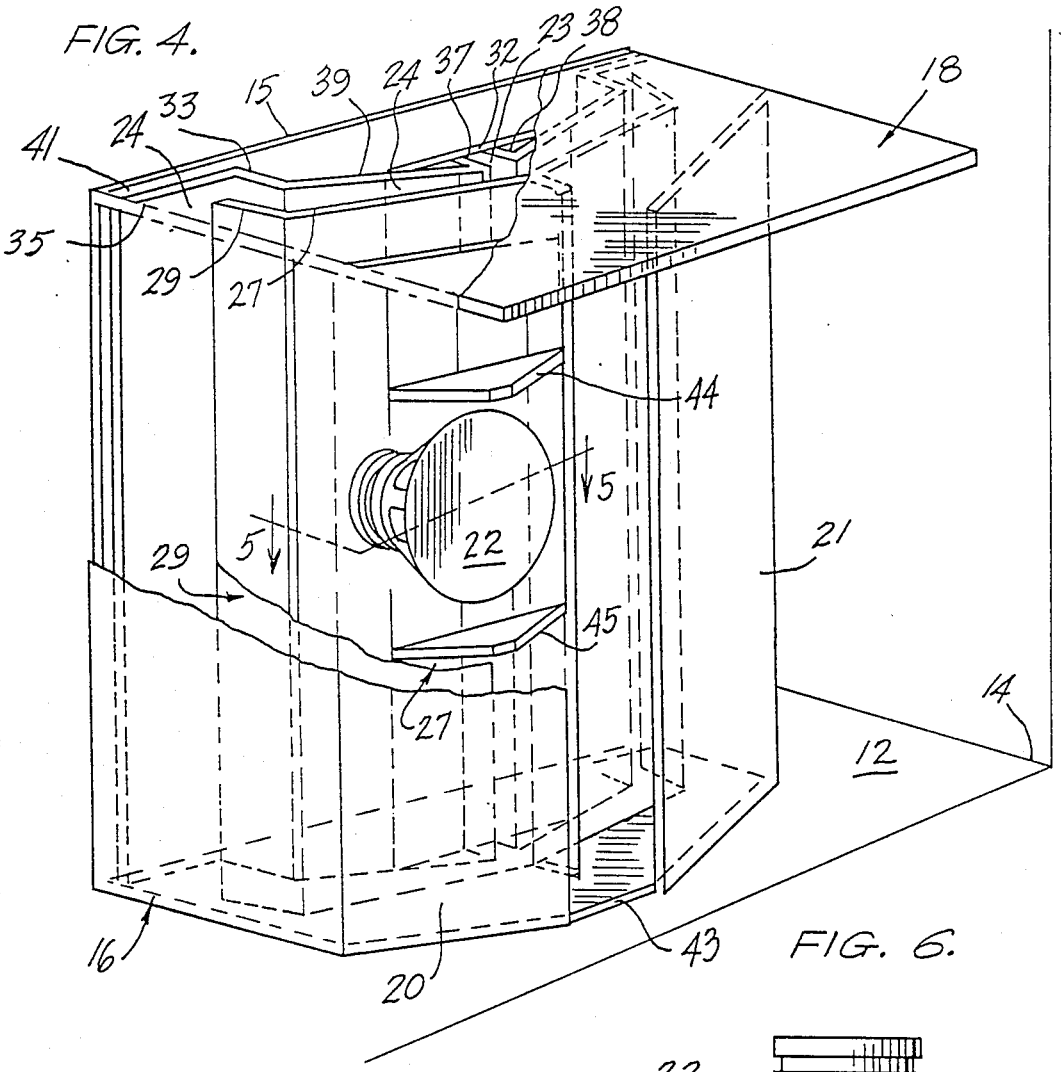
FIG. 6.
FIG. 5.
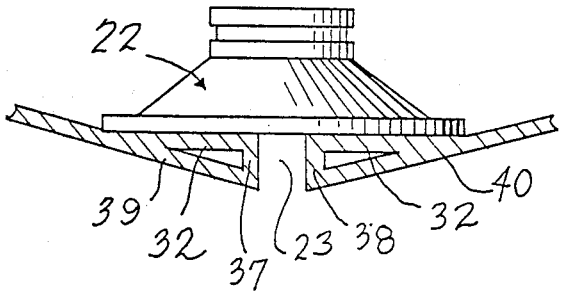
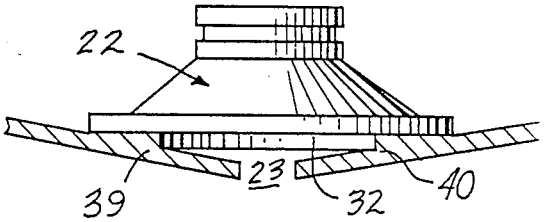
FIG. 7.
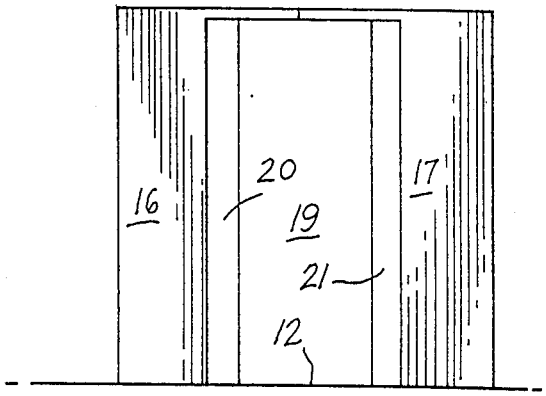

LOW FREQUENCY LOUD SPEAKER

BACKGROUND OF THE INVENTION

The present invention relates to loud speakers. More particularly, it relates to low frequency loud speakers for use adjacent to two mutually perpendicular, intersecting boundaries of a room, such as a floor and a wall, a ceiling and a wall or two walls.

For over sixty years loudspeakers have undergone an evolution in design beginning with a simple, electromechanically driven diaphragm invented by Chester W. Rice and Edward W. Kellogg reported in the Proceedings of the International Radio and Electronics Society in 1923. As the ability to record and preserve sounds electronically has improved, so has the need to transduce electrical impulses into sound waves with greater fidelity.

For accurate reproduction of musical sounds waves, a range of frequencies must be possible from a loud speaker without distortion or alternation of the original music by the resonant frequencies of the speaker itself.

Considering the full range of frequencies a human being can hear, from approximately 40 Hertz (Hz) to 15,000 Hz or nine octaves, the midrange frequencies between 1,000 Hz and 5,000 Hz are the most important. For example, humans hear best and speak at frequencies in the midrange; distortion of sounds in the mid range seems to irritate the listener more than distortion at the high or low end of audible frequencies.

The low frequencies, however, are the most difficult for a speaker to reproduce. It is known that the horn is an acoustic transformer whose transformer action creates a better impedence match between the driver and the air. This is extremely important due to the fact that the pitch of the tone decreases as the wavelength increases. For this reason, physical laws dictate a certain sound generating surface for adequate power output and efficient operation. When a diaphragm's physical dimensions are small in comparison to the wavelength being radiated, the acoustic power output of the source will be small.

The direct radiator loudspeaker used in a simple baffle must attempt to grab hold of all the air in direct contact with the diaphragm. The match between the diaphragm size and all the air is a poor one resulting in low efficiency. By using a horn the impedence match between the driver and the air at the mouth of the horn is improved because the mouth of the horn is in contact with a much larger surface of air.

An important means of compensating for limitations in the size of a diaphragm has been the use of a horn. A horn is simply a reasonably rigid barrier to a column of air through which sound waves move. However, to maintain a certain size sound generating surface, a horn's dimensions must approach a sizable fraction of the cutoff wavelength.

For a horn to successfully load a loudspeaker, certain conditions must be met. For a given low frequency response, the horn's throat size, length, flare rate and mouth size must be carefully chosen. The flare rate and the diameter of the horn mouth determine the lowest frequency at which the horn will operate. If the cross section of the horn perpendicular to its long dimension increases uniformly from throat to mouth so that the flare rate along the length of the horn is constant, the horn will transform the wave and radiate it more efficiently. If the cross sectional area of the horn increases exponentially with its length, the horn transforms sound waves very efficiently. Furthermore, the longer the exponential horn, the lower the frequency it can radiate; but the size of the mouth of an exponential horn increases rapidly, exponentially, with its length. Thus, the designer of an exponential horn for radiating low frequency sound waves must balance a speaker's lowest frequency response against the horn's ultimate length and the size of the horn mouth.

In the past large horns have been built for locations where space was not a limitation. Many of these systems occupy more than 100 cubic feet of space. In the home, however, space is usually unavailable for systems of this size. Usually, the volume limitation is further constrained by the size of a standard doorway through which the speaker must be moved.

However, it is possible to fold a horn so that the length is significantly reduced. Horns have been folded into complicated shapes to reduce their external dimensions or to increase length without creating an unmanagable horn. Bifurcating, or splitting the horn, often simplifies the internal shape of a folded horn.

Numerous loud speakers have been designed to incorporate a labyrinth or concentric cylinders or chambers of other shapes as a means for creating a folded path of great length and increasing cross section for radiating low frequencies. However, very long paths introduce a form of sound distortion called time-delay distortion, that is, distortion due to the separation of base and treble events because of the extra time it takes the low frequency sounds to travel through the horn and ultimately to the listener while the directly radiated mid and high frequencies produced at the same time have already arrived. A horn of about four feet in length is the maximum length the low frequencies should travel compared to the distance traveled by mid and high frequencies before time-delay distortion becomes noticeable.

Additionally, there have been several techniques employed to reduce the size of the horn needed to produce high fidelity sound. For example, placing the horn in the corner of a room takes advantage of the technique called imaging to enhance power output. By radiating sound waves from a corner, the diapragm radiates the wave into only one eight of the space of a speaker suspended in free space. The power of the sound wave is not dissipated over all space but only one eight because the sound is reflected off the three mutually perpendicular interfacing surfaces of a room. Furthermore, the three mutually perpendicular surfaces of a corner act as extensions of the corner-placed horn because they form diverging sound boundaries just as the horn is a diverging sound boundary. Corner placement is a very effective technique for reducing the size of the speaker or improving low frequency response by using the corner to confine the sound wave once outside the speaker and as an extension of the flare of the speaker horn.

However, although corner placement improves the low frequency response of a speaker, it affects the mid frequencies adversely. By moving a speaker away from a corner to the side of a room, mid-frequency response is improved. Furthermore, side placement improves the quality of the low frequency response because low frequency output is a more uniform function of frequency for a side-placed speaker.

Another technique is the use of an enclosure or back air chamber behind the sound-generating diaphragm to create a resistence of the air reacting against the backward movement of the diaphragm. This technique balances the air mass load focused on the front side of the diaphragm with an equivalent air mass provided by an appropriately sized back air chamber. This is very effective in reducing distortion associated with the non-linear motion of the diaphragm allowing the speaker to see a more resistive load, thereby increasing low frequency output.

If this enclosure is properly sized and vented, the sound waves from the back of the diaphragm can be directed out of the back air chamber to join in phase with the sound waves produced by the front of the diaphragm to further increase output.

There are numerous loud speaker designs. Typical of earlier designs was the labyrinth or maze such as disclosed in the patent of Mercurius (U.S. Pat. No. 2,277,525), Forrester (U.S. Pat. No. 2,646,852) and Pappanikolaou (U.S. Pat. No. 4,165,761).

Several designs have openable panels to allow the low frequencies to be directed into a room other than by direct radiation from the diaphragm front. Weil (U.S. Pat. No. 1,820,996) and Read (Pat. No. 2,805,729) have such panels, the former to be closed when the speaker is not in use and the latter to be closed to create an infinite backwave.

Corner placement has been advocated for year. See for example Stone's Sound Producing Device (Pat. No. 1,819,721). Two patents issued to Klipsch (U.S. Pat. Nos. 2,310,243 and 2,373,692) disclose speakers designed for corner placement. Pat. No. 2,310,243 shows an enclosure designed to back load the low frequency speaker by providing a horn receiving sounds from the back of the diaphragm and directing those sounds directly into the corner of a room. The sound continues to expand from the back of the speaker into the spaces between the sides of the horn and the side walls. Thus, the two intersecting walls and the floor, or ceiling, cooperate to extend the apparent size of the horn. The mid and high frequencies are radiated directly from the forward side of the diaphragm.

Pat. No. 2,373,692 discloses a loudspeaker also having a folded horn that directs sound into a room corner where it follows an expanding path between the speaker and the side walls of the room. With the exception of the horn outlet, the enclosure is sealed where the low frequency driver is mounted on the interior of the speaker enclosure with the front of the diaphragm connected to the horn throat projector via throat. The structure not only serves to form the horn boundary and a location for the driving unit within the speaker, but also provides an air chamber rearwardly of the diaphragm. This properly sized air chamber serves to offset the mass reactance of the throat impedence.

The Gillum and Klipsch patent (U.S. Pat. No. 4,210,723, discloses a large bifucated folded horn with a rear-facing diaphragm. An unvented back air chamber behind the sound generating diaphragm creates a resistence against the backward movement of the diaphragm. The back air chamber resistence balances the resistence of the air in the horn in front of the diaphragm. This loud speaker is designed to be used away from walls and in particular in auditoria on a stage with only the stage surface to help direct sound.

Many of the previous designs are for speakers for corner use where the mid range frequencies are adversely affected along with woofer output versus frequency. Many designs have very long sound paths but do not have the proper flare rate relative to the path length to transform the low frequency sound wave efficiently. Those that have horns are inefficiently designed and do not have the proper geometric relationship of throat to mouth. None takes advantage of the outside as well as the inside of the speaker to extend the apparent size of the horn. None uses a vented back air chamber to combine front and back waves for greater power output.

It is an object of the present invention to overcome these objections in the prior art. Specifically, it is an object of the present invention to project low frequency sound waves from a compact loud speaker positioned away from room corners without distorting the mid and high frequency sound waves. It is a further object of the invention to project undistorted low frequency sound waves with substantial and uniform power output through the operating range. It is a still further object of the invention to project sound waves from a rear facing diaphragm into a bifucated, folded exponential horn of sufficient length to produce efficiently sounds waves having a frequency as low as 40 Hz. It is still a further object of the invention to cover the frequency range from 40 Hz to 400 Hz with high fidelity. It is a still further object of the invention to use two mutually intersecting planes such a floor and a wall, a ceiling and a wall or two walls to cooperate with the speaker to extend the apparent length of the horn. It is a further object of the invention to use the inside and the outside of the speaker to extend the apparent length and mouth size of the horn. It is an object of the invention to use a vented back air chamber to radiate the diaphragm's back wave into the horn to further enhance power output. These and other object of the invention will be readily apparent from the description of the invention.

SUMMARY OF THE INVENTION

These and other objectives are achieved in a prefered embodiment of the present invention which provides a low frequency loud speaker for use in a room at the intersection of two, mutually perpendicular planes, such as a ceiling and a wall, a floor and a wall or two walls. Typically the speaker would be placed on the floor against a wall away from a room corner with a second speaker at a fixed distance A from it along the same wall for stereo sound reproduction. Alternatively, two speakers could be placed back to back on a stage, for example, where more sound output is desired and no wall is convenient.

Sound is generated by an electrically driven diaphragm positioned within the speaker so as to face one of the planes, such as one wall, and away from the front of the speaker. Specifically, the diaphragm is mounted in a back air chamber within the speaker and projects sound from the front face of the diaphragm through an opening in the rear surface of the back air chamber directly into a venting means centered on chamber's rear surface. The diaphragm's rear face projects sound waves into the back air chamber interior. The venting means of the chamber extends above and below the diaphragm and is divided into three regions by two vent dividers, an upper vent divider and a lower vent divider. The extensions of the venting means above and below the diaphragm enable the sound waves directed into the back air chamber from the rear face of the diaphragm to exit the chamber above and below the diaphragm through the vent and join the waves issuing from the diaphragm's front face. The regions of the vent above the upper vent divider and below the lower vent divider have approximately two and one half times the area of the region between the upper vent divider and lower vent divider. The upper vent divider is located just in the vent above the diaphragm. The lower vent divider is located in the vent just below the diaphragm.

The low frequency sound waves issue from the vent into the throat of a bifurcated, exponential horn folded laterally around the sides of the chamber, then turning rearwardly to the mouth of the horn at the back of the speaker. The sound waves are then projected from the mouth of the horn into a space defined by the rearwardly projecting top of the speaker and the intersecting planes so that the two planes, the projecting top, the back of the speaker and the outsides of the speaker act as extensions of the horn. The fixed distence A between the back of the speaker on one of the two intersecting planes is in proportion to the dimensions of the folded horn.

The design of the horn uses the interior and the exterior surfaces of the speaker in cooperation with the intersecting planes efficiently to produce a fidelity of the low frequencies previously found only in corner-placed speakers, where mid-range frequencies suffer, or speakers of much greater size. The wall, the floor and the exterior surfaces of the speaker extend the apparent size of the speaker horn as seen by the sound waves. In the prefered embodiment, the speaker has a depth of less than 20 inches, enabling it be moved through a doorway and be placed against a wall of a room so as not to interfere with the normal placement of furniture.

In the prefered embodiment, the speaker is driven by a standard, but high quality, cone-type diaphragm electroacoustic transducer. However, any means for driving a diaphragm could be used so long as the diaphragm is made to generate low frequency sound waves. The back air chamber surrounds the back of the diaphragm so that the front of the diaphragm faces out of the chamber and toward the back of the speaker and the wall behind a floor-placed speaker.

The back air chamber volume is chosen with a cavity impedence equal to the throat impedence at low frequencies. This volume may be calculated from analytical expressions described by P. W. Klipsch in "A Low Frequency Horn of Small Dimensions," Journal of the Acoustical Society of America, Volume 13, No. 2, 1941, pages 137–144.

In the prefered embodiment, the speaker comprises a front panel which has a left edge, a right edge and a top edge. Attached to the right edge of the front panel at approximately 90 degrees is the front edge of a right side panel which has a front edge, a back edge and a top edge. Attached to the left edge of the front panel at approximately 90 degrees is the front edge of a left side panel which has a front edge, a back edge and a top edge. The left side panel and the right side panel are approximately parallel to each other and form, with the front panel three adjacent sides of a rectangle when viewed from above.

The speaker has a top panel having a front edge, a left edge, a right edge and a back edge. The front edge of the top panel is attached to the top edge of the front panel at approximately 90 degrees; the right edge of the top panel is attached to the top edge of the right side panel at approximately 90 degrees; and the left edge of the top panel is attached to the top edge of the left side panel at approximately 90 degrees. The back edge of the top panel projects past the back edges of the left and the right side panels, respectively, to just touch the wall so as to space the back edges of the left and right side panels apart from the wall. The speaker has a base connecting rigidly the front panel, the left side panel, the right side panel, the back air chamber and the baffle. The base has a means to access the back air chamber.

Attached to the back edge of the left side panel is the front edge of a left wing panel having a front edge and a back edge. The left wing panel is attached at an obtuse angle alpha so that it converges inwardly, toward the right rear of the speaker. There is a right wing panel, having a front edge and a back edge, the front edge of which is attached to the back edge of the right side panel at the obtuse angle alpha so that it converges inwardly, toward the left rear of the speaker. The back edges of the left wing panel and the right wing panel, respectively, do not meet each other or touch the wall. The back edges are in spaced relation so that sound waves can travel between them into the space rearward of the speaker.

The width of the space between the back edges of the left and right wing panels, respectively, is such that the exponential flare rate of the horn's cross sectional area is maintained when the sound waves issue between the back edges.

The back air chamber has a chamber panel parallel to the front panel of the speaker and rearward thereof which chamber panel has a left edge and a right edge, a left chamber side wall having a front edge and a back edge, the back edge of which is attached to the left edge of the chamber panel at approximately 90 degrees, a right chamber side wall parallel to the left chamber side wall which right chamber side wall has a front edge and a back edge and which back edge of the right chamber side wall is attached to the right edge of the chamber panel at approximately 90 degrees, a left chamber adjustment wall having a left edge and a right edge which right edge of the left chamber adjustment wall is attached to the front edge of the left chamber side wall at approximately 90 degrees so that the left chamber adjustment wall is parallel to the front panel of the speaker and the left edge of which left chamber adjustment wall is attached to the left side panel a small distance rearward of the front panel, a right chamber adjustment wall having a left edge and a right edge the left edge of which right chamber adjustment wall is attached to the front edge of the right chamber side wall at approximately 90 degrees so that the right chamber adjustment wall is parallel to the front panel of the speaker and the right edge of which right chamber adjustment wall is attached to the right side panel a small distance rearward of the front panel of the speaker. The chamber panel as an opening therein centered on and congruent with the front face of the diaphragm.

The spaces defined in the back air chamber between the left chamber adjustment wall and the front panel and between the right chamber adjustment wall and the front panel adjust the size of the horn passage as it fold around the left and right arm panels.

The back air chamber of the present invention is not completely sealed. It has a venting means through which air and, thus, sound waves may pass into the bifucated, folded, exponential horn to join the sound waves from the front of the diaphragm. The sound waves from the front face of the diaphragm and the back air chamber enter the vent forward of the diaphragm and towards the rear of the speaker. The vent defines the horn throat.

The venting means has a left vent wall and a right vent wall spaced apart from the left vent wall and parallel thereto. Both the left vent wall and the right vent wall are perpendicular to the chamber panel. Attached to the back edge of the left vent wall is a left vent support wall, having a left edge and a right edge, which left vent support wall is positioned so that its right edge meets the left vent wall and its left edge meets the left edge of the chamber panel at an angle delta. Attached to the right vent wall is a right vent support wall, having a left edge and a right edge which right edge of the right vent wall meets the right edge of the chamber panel at the same angle delta. The left and right vent support walls thus seal the back air chamber to the left and right, respectively, of the left and right vent walls and support the left and right vent walls, respectively.

The vent also has an upper vent divider interconnecting the left vent support wall, the left vent wall, the right vent wall and the right vent support wall and positioned just above the diaphragm. The vent also has a lower vent support wall interconnecting the left vent support wall, the left vent wall, the right vent wall and the right vent support wall and positioned just below the diaphragm. The upper vent divider separates the region above the upper vent divider from the region in the vent immediately in front of the diaphragm. The lower vent divider separates the region below the lower vent divider from the region in the vent immediately in front of the diaphragm.

The horn of the speaker is a set of two symmetric passages defined by the left and right panels and the top panel of the speaker, the left and right wing panels, a baffle within the speaker, the left and right vent support walls, the left and right chamber side walls and the left and right chamber support walls. The throat of the horn is between the left and right vent walls.

At the throat the sounds waves enter the bifurcated horn and travel to the left and the right. The cross section of the horn passages are roughly rectangular in shape having a height somewhat less than the height of the speaker and a width that increases along the passages from the throat to the mouth of the horn. The rate of increase is approximately exponential, doubling in cross sectional area every sixteen inches.

The length of the horn of the speaker from the throat to the mouth at the rear of the speaker is approximately four feet. However, the top panel of the speaker extends beyond the back of the speaker toward the wall to set the speaker away from the wall by a fixed distance. When the speaker is moved against the wall so that the projecting top panel just touches the wall, the back of the speaker, the wall, the floor and the top panel act as an extension of the horn. The sound travels though the space from behind the speaker and into room. Once it emerges from behind the speaker, the outsides of the left and right panels and the floor and the wall act as further extensions of the speaker, continuing the flare of the exponential horn. Once past the sides of the speaker, the outside of the front panel of the speaker and the floor further act as extensions of the exponential horn.

Within the speaker is a baffle for creating part of the sides of the horn in cooperation with the left side panel, the right side panel, the left wing panel, the right wing panel, the top panel, the vent and the back air chamber. The baffle from the top has bilateral symmetry and has five panels: a neck panel, a left shoulder panel, a right shoulder panel, a left arm panel and a right arm panel.

The neck panel is centered on the vent and projects from the baffle generally rearwardly to direct the sound waves into the space between the back edges of the left wing panel and the right wing panel. The left shoulder panel is attached to the neck panel and projects generally laterally and slightly forwardly to the left of the neck panel between the left wing panel, defining a passage between the left wing panel and the left shoulder panel, and the left vent support wall, defining a passage between the left shoulder panel and the left vent support wall.

The right shoulder panel is attached to the neck panel projects generally laterally to the right and slightly forwardly of the neck panel between the right wing panel, defining a passage between the right wing panel and the right shoulder panel, and the right vent support wall, defining a passage between the right shoulder panel and the right vent support wall. The angle between the left shoulder and the right shoulder panels is angle beta.

The baffle has a left arm panel attached to the left shoulder panel and projecting generally forwardly and slightly laterally of the left shoulder panel at an angle gamma between the left chamber side wall, defining a part of the bifurcated passage between the left arm panel and the left chamber side wall, and the left side panel, defining another part of the bifurcated passage between the left arm panel and the left side panel. These two parts of the passage meet at the end of the left arm panel which is in spaced relation to the left chamber adjustment wall.

The baffle has a right arm panel attached to the right shoulder panel and projecting generally forward and slightly laterally of the right shoulder panel at the angle gamma and which right arm panel is between the right chamber side wall, defining a part of the bifurcated passage between the right chamber side wall and the right arm panel, and the right side panel, defining another part of the bifurcated passage between the right side panel and the right arm panel. These two parts of the passage meet at the end of the right arm panel which is in spaced relation with the right chamber adjustment wall.

The chamber panel has at least one opening for sound waves to pass from the back air chamber into the vent. One opening is for the sound waves from the front of the diaphragm. In the prefered embodiment, the opening is a rectangle extending vertically from the top of the speaker to the bottom and having the same width as the space between the left and right vent walls, centered on the diaphragm and the vent so that sound waves can travel from the back air chamber into the vent and from the front of the diaphragm into the vent.

Alternatively, there could be several openings, at least one above, one below and one centered on the diaphragm, each preferrably circular openings. Although these openings above and below the diaphragm may be simply openings in the chamber panel, they are, in the alternate prefered embodiment, circular openings covered with an accoustical material to act as accoustical radiators driven by the pressure of the sound waves built up in the back air chamber. Any openings in the chamber panel lie between the left and the right vent walls so that sound will pass from the openings into the vent. In the alternate embodiment, the openings are between the left and right vent support walls, there being no left and right vent walls.

BRIEF DESCRIPTION OF THE DRAWINGS

Referring to the accompanying drawings, which are for illustrative purposes:

FIG. 4 is a right rear perspective view of the speaker through the wall with a portion of the speaker cut away;

FIG. 5 is a detail of a cross section along line 5—5 of the venting means;

FIG. 6 is a detail of a cross section along line 5—5 of an alternative embodiment of the venting means; and FIG. 7 is a side plan view of two speakers back to back for use when no wall is convenient.

DESCRIPTION OF THE PREFERED EMBODIMENT

Figure 1:
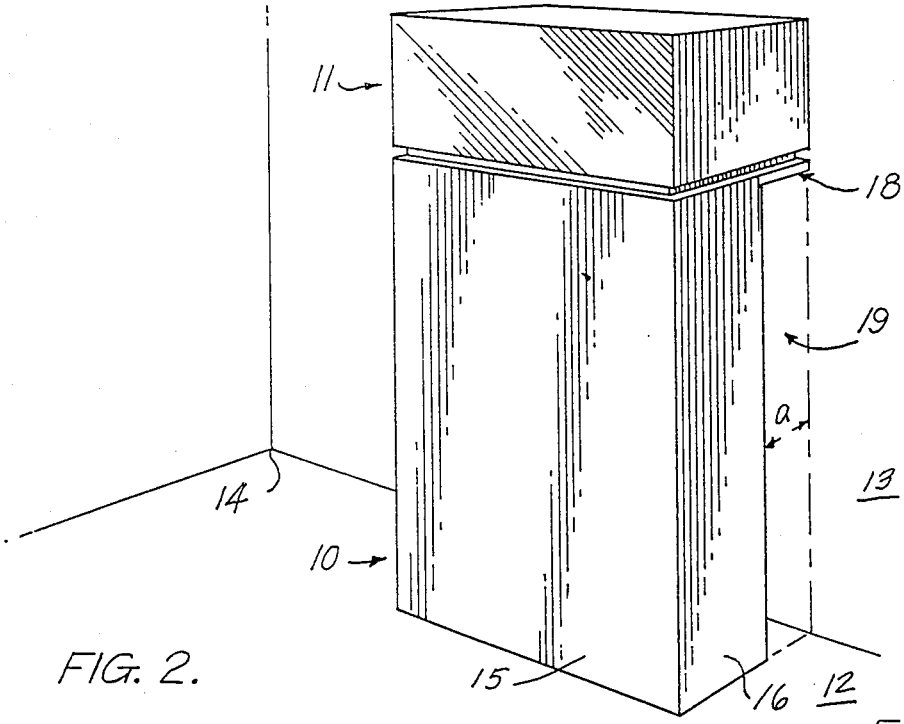
FIG. 1 is a perspective view of the speaker from the right front showing the speaker's relationship to the floor, the wall and the corner of a room.

The speaker is designed to cooperate with two intersecting planes such as a floor and a wall, two walls or a wall and a ceiling. FIG. 1 shows the low frequency speaker 10 placed on a floor 12 adjacent to a wall 13. An example of a mid and high frequency speaker 11 is shown on top of the low frequency speaker 10 as one means of using the present invention. The speaker is designed to be used away from a room corner 14 a fixed distence A shown best on FIG. 3.

The front panel 15 of speaker 10 is solid and is generally in the form of a rectangle approximately 39 inches high and 32 inches wide. FIG. 1 shows the right side panel 16 and the top panel 18. Note that top panel 18 projects rearwardly of the speaker 10 to just touch wall 13 and thereby create a space 19 between the back of speaker 10 and wall 13.

Figure 2:
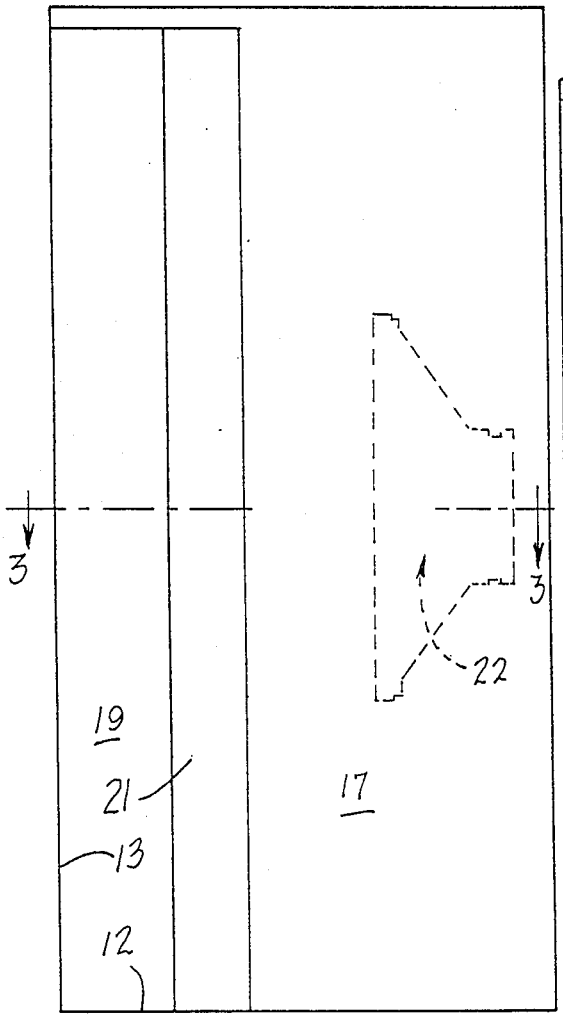
FIG. 2 is a left plan view showing the position of the speaker with respect to the floor and wall and the location of the diaphragm.

The space 19 between wall 13 and floor 12 is better seen in FIG. 2 which also shows the left side panel 17 and the left wing panel 21 converging inwardly at an angle alpha toward the right side of speaker 10. In the prefered embodiment, angle alpha is approximately 103 degrees.

The approximate location of the diaphragm 22 is indicated in FIG. 2 in broken lines. The diaphragm 22 is positioned in the front of the speaker 10 and faces the back of the speaker 10.

Figure 3:
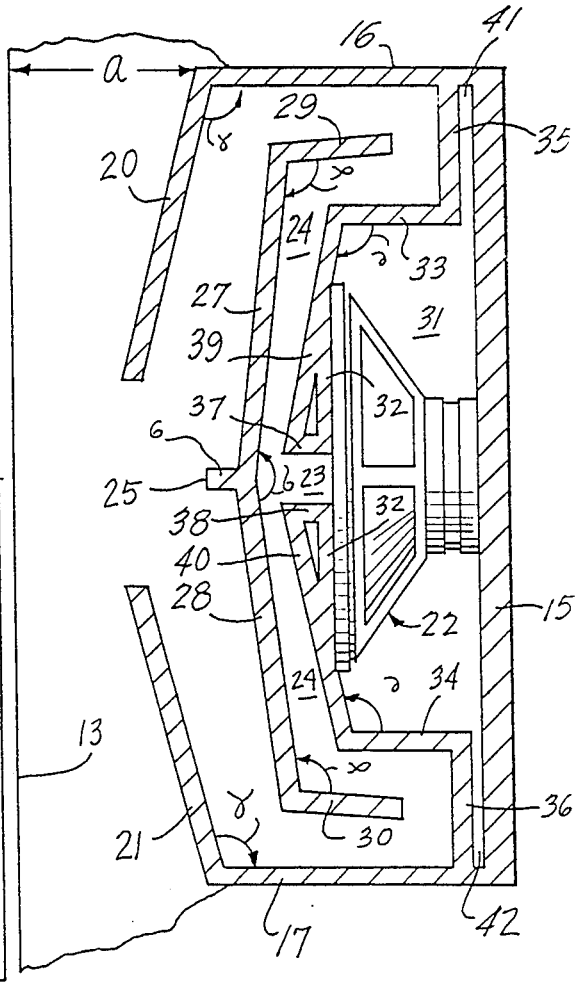
FIG. 3 is a cross sectional view of the speaker along line 3—3 of FIG. 2.

The bifurcated horn, the venting means and the back air chamber are best seen in FIG. 3, a cross sectional view of the speaker at 3—3 of FIG. 2. The front panel 15 is attached to the right side panel 16 and the left side panel 17 at approximately 90 degree angles. The right wing panel 20 is attached to the right side panel 16 at an obtuse angle alpha so that the right wing panel 20 converges inwardly to the left side of speaker 10. Similarly, the left wing panel 21 is attached to the left side panel 17 at the obtuse angle alpha so that the left wing panel 21 converges inwardly to the right side of the speaker 10.

The diaphragm 22 is mounted in back air chamber 31, centered on vent 23. Sound waves pass from the front of diaphragm 22 through the chamber panel 32 into the vent 23 where they are split by the baffle 25 into bifurcated passage 24.

Baffle 25 has a neck panel 126, a right shoulder panel 27 projecting laterally to the right and forwardly of the neck panel 26, a left shoulder panel 28 projecting laterally to the left and forwardly of the neck panel 26. The angle between the left shoulder panel and the right shoulder panel is angle beta. In the prefered embodiment, angle beta is 166 degrees.

The baffle 25 has a right arm panel 29 attached to the right shoulder panel 27 projecting forwardly of the right shoulder panel 27 and slightly laterally at an angle gamma. Right arm panel 29 is in spaced relation to right side panel 16, right chamber adjustment wall 35 and right chamber wall. The baffle 25 has a left arm panel 30 attached to the left shoulder panel 28 projecting forwardly of the left shoulder panel 28 and slightly laterally also at the angle gamma. Left arm panel 30 is in spaced relation to the left side panel 17, left chamber adjustment wall 36 and left chamber wall 34. In the prefered embodiment, angle gamma is approximately 101 degrees. The baffle 25 extends almost the full height of the speaker 10 and serves to define bifurcated passage 24 running from the vent 23 to the rear of speaker 10.

The back air chamber 31 has a chamber panel 32, a right chamber side wall 33 attached to the chamber panel 32 at approximately a 90 degree angle, a left chamber side wall 34 attached to the chamber panel 32 at approximately a 90 degree angle so that the right chamber wall 33 and the left chamber wall 34 are parallel and opposite each other. Projecting from the right chamber side wall 33 at approximately a 90 degree angle is the right chamber adjustment wall 35 which is also attached to the right side panel 16 so as to form space 41 between the right chamber adjustment wall 35 and the front panel 15. Projecting from the left chamber side wall 34 at approximately a 90 degree angle is the left chamber adjustment wall 36 which is also attached to the left side panel 17 so as to form space 42 between the left chamber adjustment wall 36 and the front panel 15.

To the rear of the chamber panel 32 is the venting means. In FIG. 3, showing the prefered embodiment, the venting means comprises a right vent wall 37 and a left vent wall 38 spaced apart from the right vent wall 37 to allow sound waves to pass from the diaphragm 22 and back air chamber 31 into bifurcated passage 24. The venting means also comprises a right vent support wall 39 that is attached to the right vent wall 37 at one end and to the right chamber side wall 33 at the other so as to meet the right chamber side wall 33 at an angle delta in order to define the part of passage 24 that runs between the right shoulder arm 27 and the right vent support wall 39 and to seal the right rear portion of the back air chamber 31 and to support the right vent wall 37.

The venting means has a left vent support wall 40 that is attached at one end to the left vent wall 38 and to the left chamber side wall 34 at the other so as to be at the same angle delta with respect to the left chamber side wall 34 and to define the part of passage 24 that runs between the left shoulder arm 28 and the left vent support wall 40, to seal the left part of the back air chamber 31 and to support the left vent wall 38. In the prefered embodiment angle delta is approximately 100 degrees.

The relationship of the elements of the venting means can be best seen in FIG. 4 which shows from the right rear perspective the speaker 10 with diaphragm 22 positioned in the middle of the back air chamber 31 facing rearward to project sound through a rectangular opening 23 in the chamber panel 32 and between the right vent wall 37 and the left vent wall 38. Also shown in FIG. 4 is the base 43 and the upper vent divider 44 and the lower vent divider 45.

Bifurcated passage 24 is defined by, on the right of speaker 10, the right shoulder panel 27 and right vent support wall 39, right arm panel 29 and right chamber side wall 33, right chamber adjustment wall 41, right side panel 16 and right arm panel 29, and right shoulder panel 27 and right wing panel 20. The sound waves exit the speaker between right wing panel 20 and left wing panel 21 into space 19 between top panel 18 the wall 13, the floor 12 and the right wing panel 20 and the left wing panel 21. From space 19 the sound waves travel between wall 13 and the left side panel 17 and right side panel 16 into the room.

FIG. 5 details the venting means along line 5—5 of FIG. 4. A narrow rectangular opening 23 is formed in the prefered embodiment at the front face of the diaphragm 22 in chamber panel 32 and between right vent wall 37 and left vent wall 38. The right vent support wall 39 which connects the right vent wall 37 to the right chamber side wall 33 (not shown in FIG. 5) provides support for the right vent wall 37. The left vent support wall 40 provides support for the left vent wall 38.

FIG. 6 shows an alternative embodiment for the venting means. In the alternative embodiment a first circular opening is made in the chamber panel 32 centered on the diaphragm 22. The right vent wall 37 and the left vent wall 38 are eliminated. Openings above and below the first circular opening allow sound waves to exit the back air chamber 31.

When greater sound output is desired or no wall against which the speaker 10 can be placed, two speakers can be placed back to back with the back edges of their top panels meeting, as shown in profile in FIG. 7.

The invention and its attendant advantages will be understood from the foregoing description and it will be apparent that changes may be made in the form, dimensions, construction and specific arrangement of the parts without departing from the spirit and scope of thereof or sacrificing any of its material advantages, the arrangements hereinbefore described being merely by way of example. I do not wish to be restricted to the specific dimensions or forms shown or uses mentioned except as defined in the accompanying claims, therein various portions have been separated for clarity of reading and not for emphasis.

I claim:

1. A speaker used adjacent two mutually perpendicular intersecting planes which planes interface and cooperate to form a part of the speaker which speaker comprises (a) a diaphragm for generating sound waves having a front and a back which front faces one of the two intersecting planes;

(b) a means for driving the diaphragm to produce sound waves;

(c) a back air chamber surrounding the back of the diaphragm for partially enclosing a volume of air behind the diaphragm and for receiving the sound waves produced by the back of the diaphragm;

(d) a venting means centered on the front of the diaphragm and extending above and below the diaphragm for receiving the sound waves from the front of the diaphragm and from the back air chamber; and (e) a horn having a throat centered on the venting means and opposite the diaphragm to receive the sound waves issuing through the venting means from the diaphragm and the back air chamber, which horn has a mouth communicating with the throat for receiving the sound waves and projecting the sound waves out of the mouth and which horn has a means for spacing the mouth by a fixed distance a from at least one of the two intersecting planes so that a space is defined between the mouth and the at least one of the intersecting planes into which space the sound waves are projected from the horn, so that the mouth of the horn is extended by the space bounded by the at least one intersecting planes 2. The loud speaker of claim 1 wherein the horn further comprises (a) a base;

(b) a front panel attached at right angles to the base and having a left edge, a right edge and a top edge;

(c) a right side panel having a front edge, a back edge and a top edge and which front edge of the right side panel is attached to the right edge of the front panel at approximately 90 degrees.

(d) a left side panel having a front edge, a back edge and a top edge and which front edge of the left side panel is attached to the left edge of the front panel at approximately 90 degrees;

(e) a top panel having a front edge, a left edge, a right edge and a back edge, and which front edge of the top panel is attached to the top edge of the front panel at approximately 90 degrees, which right edge of the top panel is attached to the top edge of the right panel at approximately 90 degrees, which left edge of the top panel is attached to the top edge of the left panel at approximately 90 degrees and which back edge of the top panel extends beyond the back edges of the left and right panels to just touch one of the perpendicular planes so as to space the back edges of the left and right panels apart from one of the two intersecting planes;

(f) a left wing panel having a front edge and a back edge which front edge is attached to the back edge of the left side panel at an obtuse angle alpha so that the left wing panel converges inwardly and rearwardly of the speaker;

(g) a right wing panel having a front edge and a back edge which front edge is attached to the back edge of the right side panel at the obtuse angle alpha so that the right wing panel converges inwardly and rearwardly of the speaker and which back edge of the right wing panel is spaced apart from the back edge of the inwardly and rearwardly converging left wing panel and the intersecting plane touched by the back edge of the top member and which space between the back edge of the left wing panel and the back edge of the right wing panel defines the mouth of the horn; and (h) a baffle means within the horn for dividing the horn into two symmetrical passages to receive sound waves from the vent and conduct the sound waves in cooperation with the chamber, the left side panel, the right side panel, the left wing panel and the right wing panel to the rear of the speaker.

3. The speaker of claim 2 wherein the baffle means further comprises (a) a neck panel centered on the vent to direct the sound waves into the space between the back edges of the left wing panel and the right wing panel;

(b) a left shoulder panel attached to the neck panel so as to project generally laterally to the left of the neck panel and which left shoulder panel is in spaced relation to the chamber and the left wing panel;

(c) a right shoulder panel attached to the neck panel so as to project generally laterally to the right of the neck panel and which right shoulder panel is in spaced relation to the chamber and the right wing panel and which right shoulder panel forms an angle beta with repect to the left shoulder panel;

(d) a left arm panel attached to the left shoulder panel at an angle gamma so as to project generally forward of the left shoulder panel and slightly laterally of the left shoulder panel and which left arm panel is in spaced relation to the chamber and the left side panel; and (e) a right arm panel attached to the right shoulder panel at the angle gamma so as to project generally forward and slightly latterally of the right shoulder panel and which right arm panel is in spaced relation to the chamber and the right side panel.

4. The speaker of claim 1 wherein the back air chamber further comprises (a) a chamber panel which chamber panel has a left edge and a right edge and at least one opening to communicate sound waves from the back of the diaphragm to the vent means;

(b) a left chamber side wall having a front edge and a back edge which back edge of the left chamber side wall is attached to the left edge of the chamber panel at approximately 90 degrees;

(c) a right chamber side wall having a front edge and a back edge which back edge of the right chamber side wall is attached to the right edge of the chamber panel at approximately 90 degrees;

(d) a left chamber adjustment wall having a left edge and a right edge which right edge of the left chamber adjustment wall is attached to the front edge of the left chamber side wall at approximately 90 degrees and which left edge of the left chamber adjustment wall is attached at approximately 90 degrees to the left side panel rearward of the front panel; and (e) a right chamber adjustment wall having a right edge and a left edge and which left edge of the right chamber adjustment wall is attached to the front edge of the right chamber side wall at approximately 90 degrees and which right edge of the right chamber adjustment wall is attached at approximately 90 degrees to the right side panel rearward of the front panel.

5. The speaker of claim 4 wherein the venting means comprises (a) a left vent wall rearward of the back air chamber perpendicular to the chamber panel and which left vent wall is to the left of all of the at least one opening in the chamber panel;

(b) a right vent wall spaced apart from the left vent wall and parallel thereto and to the right of all of the at least one opening in the chamber panel so as to create a space that defines the throat of the horn through which throat sound waves pass in a direction parallel to the left vent wall and right vent wall;

(c) a left vent support wall attached to the left vent wall, the left edge of the chamber panel and the back edge of the left chamber side wall at an angle delta for supporting the left vent wall and sealing a portion of the back air chamber; and (d) a right vent support wall attached to the right vent wall, the right edge of the chamber panel and the back edge of the right chamber side wall at the angle delta for supporting the right vent wall and sealing a portion of the back air chamber;

(e) an upper vent divider interconnecting the left vent support wall, the left vent wall, the right vent wall and the right vent support wall just above the diaphragm; and (f) a lower vent divider interconnecting the left vent support wall, the left vent wall, the right vent wall and the right vent support wall just below the diaphragm.

6. The speaker of claim 4 wherein the vent means comprises (a) a left vent support wall attached to the left edge of the chamber panel and to the left chamber side wall at an angle delta for sealing a portion of the back air chamber;

(b) a right vent support wall attached to the right edge of the chamber panel and to the right chamber side wall at the angle delta for sealing a portion of the back air chamber and defining in cooperation with the left vent support wall the throat of the horn;

(c) an upper vent divider connecting the left vent support wall and the right vent support wall just above the diaphragm; and (d) a lower vent divider connecting the left vent support wall and the right vent support wall just below the diaphragm.

7. The speaker of claim 5 wherein the at least one opening of the chamber panel is in the shape of a rectangle that has a length at least as long as the longest dimension of the front of the diaphragm and which rectangle is centered on the front of the diaphragm.

8. The speaker of claim 6 wherein the at least one opening of the chamber panel is circular in shape and a first at least one opening is centered on the diaphragm and a second at least one opening is above the first at least one opening and a third at least one opening is below the first at least one opening.

9. The speaker of claim 8 wherein the second and the third at least one opening are covered with an accoustical material.

10. The speaker of claim 2 wherein the left vent wall, the right vent wall, the left shoulder panel, the right shoulder panel, the left vent support wall, the right vent support wall, the left arm panel, the right arm panel, the left chamber side wall, the right chamber side wall, the left chamber adjustment wall, the right chamber adjustment wall, the left side panel, the right side panel, the left wing panel, the right wing panel and the neck panel cooperate to form a bifurcated passage for sound waves to travel from the throat of the horn to the mouth of the horn which bifucated passage has a cross sectional area perpendicular to the direction of the sound waves which cross sectional area increases as the sound waves travel along the bifurcated passage from the throat of the horn to the mouth.

11. The speaker of claim 10 wherein the cross sectional area of the passage approximately doubles every 16 inches.

12. The speaker of claim 11 wherein the smallest dimension is no larger than approximately 19.5 inches and the largest dimension is no large than approximately 39 inches.

13. The speaker of claim 12 wherein the angle alpha is approximately 103 degrees, the angle beta is approximately 166 degrees, the angle gamma is approximately 101 degrees and the angle delta is approximately 100 degrees, the speaker width is approximately 32 inches, the speaker height is approximately 39 inches and the speaker depth is approximately 19.5 inches.

14. The speaker of claim 12 wherein the fixed distence A is approximately 7.5 inches.

* * * * *

UNITED STATES PATENT AND TRADEMARK OFFICE

CERTIFICATE OF CORRECTION

PATENT NO. : 4,860,367

DATED : August 22, 1989

INVENTOR(S) : Carl R. Hook

It is certified that error appears in the above—identified patent and that said Letters Patent is hereby corrected as shown below:

In Column 4, line 45, the words "a fixed distance A" should read --a distance--.

Signed and Sealed this

Eighteenth Day of December, 1990

*Attest:*

HARRY F. MANBECK, JR.

*Attesting Officer*

*Commissioner of Patents and Trademarks*